United States Patent [19]

Gibby

[11] 4,151,665

[45] May 1, 1979

[54] MOUNTING FRAME

[76] Inventor: Mabel K. Gibby, 4501 Granada Blvd., Coral Gables, Fla. 33146

[21] Appl. No.: 842,678

[22] Filed: Oct. 17, 1977

[51] Int. Cl.[2] ..... D06C 3/08

[52] U.S. Cl. ..... 38/102.91; 160/404

[58] Field of Search ..... 38/102, 102.1, 102.4, 38/102.5, 102.8, 102.9, 102.91; 160/38 B, 404; 40/152, 154, 155, 156

[56] References Cited

U.S. PATENT DOCUMENTS

| | | | |
|---|---|---|---|
| 2,488,424 | 11/1949 | Morris | 160/404 X |
| 2,776,508 | 1/1957 | Hutson | 40/155 |
| 3,841,008 | 10/1974 | Cusick | 38/102.91 |
| 3,960,197 | 6/1976 | Daniels | 160/404 X |
| 3,965,601 | 6/1976 | Nielsen | 40/155 |

FOREIGN PATENT DOCUMENTS

| | | | |
|---|---|---|---|
| 608286 | 11/1960 | Canada | 160/404 |

*Primary Examiner*—Louis Rimrodt

[57] ABSTRACT

A mounting frame for a completed tapestry wherein the frame is composed of pieces each having a slide surface in a common plane, and a surface at right angles to the slide surface and over which the tapestry is adapted to be stretched and teeth means arranged in an array along the piece, and not on the slide surface, for hooked-up engagement with the tapestry for use in uniformly stretching and in holding a stretched tapestry in a display condition without wrinkles or buckles.

4 Claims, 10 Drawing Figures

MOUNTING FRAME

FIELD OF THE INVENTION

This invention relates to a mounting device for sheet material, such as a completed tapestry, and, more particularly, to pieces to be connected together to form a mounting frame and which pieces include an array of teeth or prongs to engage or hook up with the sheet for use in uniformly stretching and holding the sheet as is described more fully hereinafter.

BACKGROUND OF THE INVENTION

In the past, those who work with tapestries and seek to mount them, have had considerable difficulty in getting them uniformly stretched and held in a display position on a frame. This invention is of a mounting frame piece, and a frame composed of such pieces which have been connected together to form the frame. The frame is adapted for use in mounting the tapestry or canvas and displaying it in a uniformly stretched condition.

For example, in the past, persons with a completed needlepoint canvas, in seeking to mount the same for display, have tacked it on a board; but, as will be readily appreciated by those in the art, it is very difficult to get the canvas straight and stretched uniformly in this way and to hold it in a display position. Thus, board forms have proved to be unsatisfactory, whether staples or nails have been used. The problem has been of stretching the canvas uniformly so that it does not have wrinkles, does not buckle, and, generally, is uniformly taut in all directions.

It is, accordingly, an object of this invention to provide a mounting frame, and pieces for a mounting frame to be connected together, and which provide a means for uniformly stretching and holding canvas, such as a completed tapestry, in a mounting frame and which mounting frame may, if desired, be provided with a decorative border or display frame.

It is, further, another object of this invention to provide an improved length or elongate piece for use in such a frame and which is adapted to be connected together and which is characterized by outwardly extending teeth or prongs all as is described more fully hereinafter.

In accordance with these and other objects which will become apparent hereinafter, the instant invention will now be described with reference to the accompanying drawings, in which:

DESCRIPTION OF PREFERRED EMBODIMENT

Figure 1:
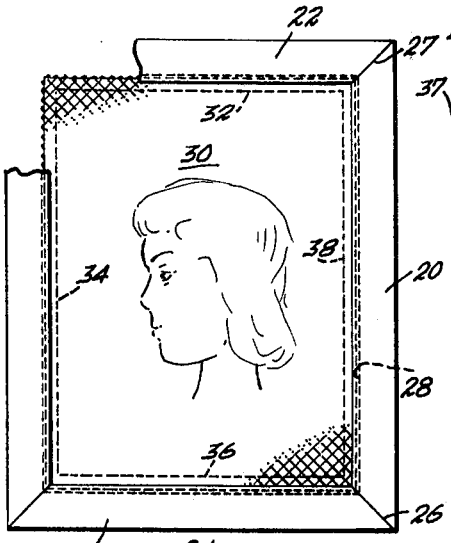
FIG. 1 is a plan view of a display frame or border about a tapestry uniformly stretched onto a mounting frame; and in which the display frame of the picture has been partly broken away to illustrate the stretched canvas over the underlying mounting frame.

Referring to the drawings, although several embodiments are illustrated, like reference characters will be utilized to designate common parts which are described hereinafter in referring to the attached drawings. FIG. 1 illustrates generally a picture. It has a border or display frame composed of pieces such as 20, 22 and 24 which are suitably fastened together at their adjacent ends, such as at the mitered corners 26 and 27. As is conventional, a groove 28 is provided in the reverse side of the border or display frame. A peripheral nest is defined for a mounting frame with a stretched canvas, the latter being generally designated by the numeral 30 in FIG. 1.

It should be noted at this juncture that this invention relates to the mounting frame and not directly to the display frame or border.

Figure 2:
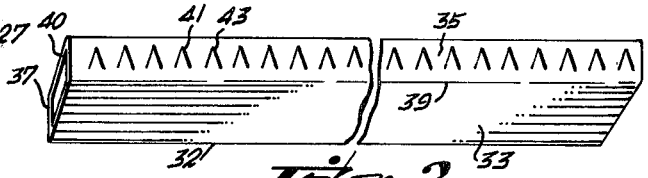
FIG. 2 is a view of a portion of a length from which appropriate pieces for the mounting frame may be cut.

The present invention is of a mounting frame for the canvas or tapestry and of a plurality of pieces, such as 32, 34, 36 and 38 which are interconnected at their respective adjacent ends to form corners of the mounting frame. More particularly, on reference to FIG. 2, the frame pieces, such as the piece designated by the numeral 32 are each provided with an upper side surface 33, an outside side surface 35, an inside side surface 37 and a bottom surface 40. The length of piece shown in FIG. 2 is cut into separate pieces which are suitably connected together to form a mounting frame in rectangular shape. Thereafter, the canvas 30 is stretched over the top or slide surface 33 and pulled downwardly over the corners 39 so that the teeth or prongs which are along the outside surface and designated by the numerals 41 and 43 bite into the cloth holding it in a uniformly stretched condition and removably gripping it during the stretching and adjusting process.

It is seen that the overall length 32 in FIG. 2 may be quite long; and that individual pieces may be cut from it to appropriate lengths, allowing for an infinite range or selection of sizes.

Figure 4:
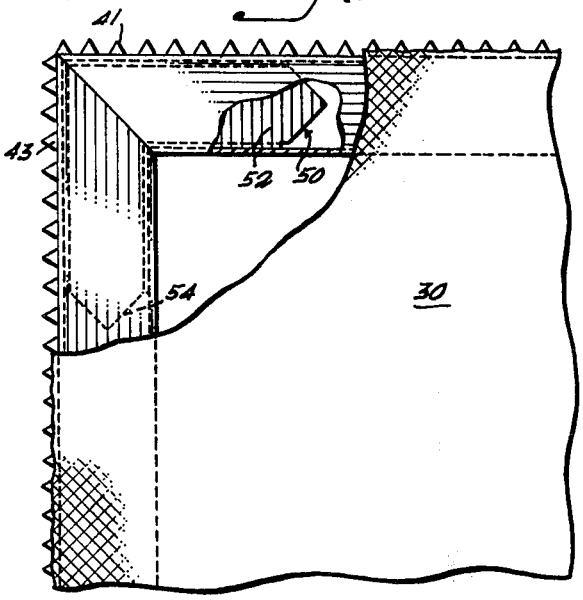
FIG. 4 is a view of the upper zone of FIG. 1 which has been broken away and illustrating the use of the connection means shown in FIG. 3.

The cut may be at a right angle to the length, as shown in FIG. 2 or, alternatively, a mitered cut may be made, for example, see FIG. 4.

Figure 3:
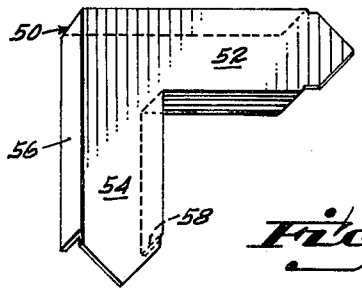
FIG. 3 is a perspective view of a connector means for use in connecting the pieces together to form a corner joint.

In the event that the pieces are connected together as in FIG. 4, a corner piece may be utilized such as that designated by the numeral 50 in FIG. 3. It is seen that this corner piece or connector means includes an L-shaped member having a first leg 52 and a right angularly arranged leg 54 and sidewalls such as 56 and 58 which may be spanned at their lower ends but which, in any event, provide rigidifying means. Each of the legs is adapted to fit into the column or hollow interior at the end of adjacent pieces and, in this manner, interconnect the mitered ends in a corner joint as shown in FIG. 4.

Figure 5:
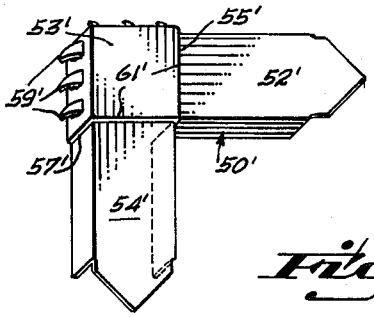
FIG. 5 is an alternative type of connection means.
Figure 6:
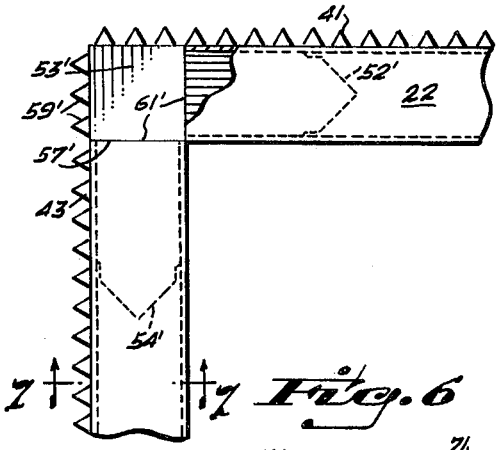
FIG. 6 is a view of the connector means of FIG. 5 being utilized for connecting together pieces at a corner.

Alternatively, instead of the ends being mitered, the ends may be cut square as shown in FIG. 2. In such embodiment a slightly modified corner piece designated by the numeral 50' is utilized in which the legs 52' and 54' are of a slightly diminished cross sectional area with respect to the extreme corner zone designated by the numeral 53'. In this embodiment, the end of a piece is slid over one of the legs until the end abuts the shoulders 55' and 57'. Further, in this embodiment, it will be seen that teeth such as 59' are preferably utilized on the corner piece to provide a surface for connecting the canvas to the mounting frame at the extreme corner zone. In the preferred embodiment, the distance or thickness of the shoulder 61' is about equal to the thickness of the pieces so that a smooth slide surface is provided. With respect to this embodiment, the connected pieces of the corner of the mounting frame shown in FIG. 5 may be seen on reference to FIG. 6.

Figure 7:
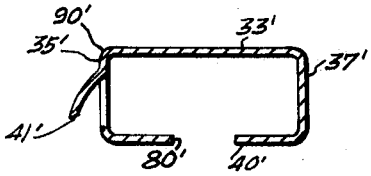
FIG. 7 is a view in cross section taken on a plane indicated by the line 7—7 of FIG. 6 and looking in the direction of the arrows and illustrating an alternative type of frame piece.

With respect to the cross sectional area shown in FIG. 7, this is a somewhat modified embodiment of the invention. The cross sectional area in this embodiment is characterized by an upper slide surface 33' and also, an inside surface 37' and outside surface 35', the latter of which is provided with teeth or prongs such as 41'. In this embodiment the bottom surface 40' is not continous and the pieces is not completely cylindrical; however, the characteristic rigidified longitudinally extending member with an upper slide surface and a generally angularly arranged, preferably right angularly arranged, surface is provided with teeth or prongs which extend away from the upper slide surface 33' and the side surface 35', so that the canvas may be pulled over the slide surface 33' folded about the corner 90' and pulled downwardly into hooked-up engagement by the teeth.

Figure 8:
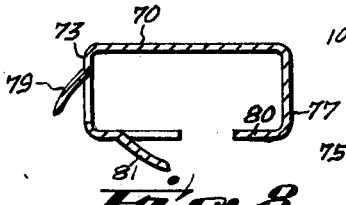
FIGS. 8, 9 and 10 are alternative types of configurations of frame pieces, and taken on a plane similar to that of FIG. 7.
Figure 9:
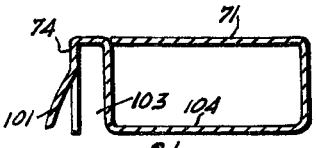
Figure 10:
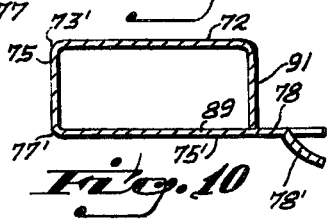

FIGS. 8, 9 and 10 are similar to FIG. 7 in that modified embodiments are shown with respect to the cross sectional area shown in FIG. 2. Again, in each of these embodiments there is an upper slide surface designated by the numerals 70, 71 and 72 in FIGS. 8, 9 and 10 respectively and, additionally, an angularly arranged surface 73, 74 and 75. The hook surface in FIG. 8 is provided with a plurality of teeth such as 79 in spaced relation therealong, and, additionally, the bottom surface 80 which spans the side surfaces 73 and 77 and is continuous is provided with a punched out secondary series of keeper teeth or prongs such as 81. In this embodiment hooks such as 79 on the outside surface adjacent the slide surface hook-up with the canvas and, additionally, the teeth 81 along the bottom surface may be used as keepers for extra holding strength. It should be pointed out that in this embodiment the floor 80 need not completely span the distance between the sides 73 and 77. In such an embodiment, FIG. 8 would resemble FIG. 7 with the exception that the teeth will be provided on the edge 80'. For a rolled form of metal construction, this is a preferred embodiment because it provides ease of access to making the teeth without the problem of access into the interior of the column or hollow longitudinally extending through the piece.

With reference to FIG. 9, as an alternative embodiment, the hooks along the hook surface 74, which are designated by the numeral 101, may be adjacent a groove 103 in the bottom 104 which may receive a spline, not shown, to nest within it and serve as a keeper means. This also serves as a recess into which the edge of the canvas may be pushed.

Alternatively, with respect to FIG. 10, the slide surface 72 may provide a corner as at 73'; but, additionally, may have an additional surface and an additional slide surface 75' and additional corner 77' as well as an extra bottom portion 78 which extends outwardly from the corner of the bottom 89 and side 91 and which provides an outwardly extending or marginal floor zone which is provided with hooks as at 78' to hook-up with the canvas. This embodiment also provides access for forming the teeth in a roll form metal construction which is a preferred embodiment.

In any event, it is seen that there has been provided pieces which are adapted to be severed from a main long length and connected together to form a mounting frame which is highly useful as a mounting device for a completed limp type of canvas, such as a tapestry, and which may be used to uniformly stretch it and to hold it in a uniformly stretched condition. The pieces of the frame are preferably of metal. It will be noted that there is required to be at least one corner between the slide surface and the toothed or hooked surface and, additionally, there are a total of at least three corners so as to define an inner column, long hole, or hollow to receive the legs of the connector means or corner pieces which are inserted between adjacent ends and, further, it is necessary that the side surface adjacent the slide surface be substantially at right angles so as to nest within the groove of the display form. In a preferred embodiment the hook surfaces are adjacent the slide surfaces, that is, in the surface which is at right angles to the slide surface and the teeth terminate at points which face away from the slide surface, the side edges converging toward the hook or toothed surface and the slide surface. Further, it is important that the teeth be close together along the hook surface. In a preferred embodiment the teeth of the pieces are spaced about four to the inch and are relatively sharp, substantially sharper than that shown in the drawings for illustrative purposes and more resembling needle points. The range should not be less than two such points per inch and, generally speaking, not more than eight per inches. In a preferred embodiment, the teeth may be $\frac{3}{8}$ of an inch apart from one another, $\frac{1}{8}$ of an inch in length and 1/16 of an inch across at the base of each tooth or needle. A suitable thickness is about 1/32 of an inch.

Some comment should be made with respect to the size, location and configuration of the teeth. It will be appreciated that if one were to slide or pull the margin of a canvas being stretched over the slide surface and then bend it around the corner and nail two nails into the part that has been pulled, the spacing between the nails would be significant because if it was of any substantial distance then there would be a puckering or relaxing of the canvas between the nails. It is for this reason that the range or distance between the teeth is important and that there be sufficient teeth to grip along the length of the stretched edge that has been pulled out over the slide surface around the angle and downwardly over the teeth. Further, the configuration of the teeth must be such as to present an exterior surface over which the material will move easily so that when the tension forces is relaxed it will then bite into it but not before.

In concluding, to properly evaluate this invention, the difference between a relatively inelastic sheet of material, a sheet of paper for example, and a sheet of relatively stretchable material, a sheet of canvas or needlepoint, for example, should be pointed out. If a sheet of paper is folded over a corner and nailed in several places along the margin, it will maintain its shape in the display plane without distortion. However, it is, generally speaking, not necessary to stretch the paper in order to mount it; indeed, to stretch it would tear it most likely. With respect to canvas materials, however, particularly tapestry and needlepoint, these type materials do not tear readily when stretched, but, rather, their elastic stretch or elongating ability is a problem and the result is that when efforts are made to mount it in a display frame the display portion is distorted. It is because of this tendency to distort that it is necessary that there be repeated adjustments in the mounting and to nail repeatedly by use of a hammer is very, very difficult if not impossible as a technique for displaying a tapestry. While it can be done with great labor and taking considerable amounts of time, it is a primary purpose of this invention to provide a frame for rapidly mounting of such a canvas or tapestry which is provided with teeth and a construction as set forth above so that this may be accomplished.

What is claimed is:

1. A mounting frame comprising, in combination a first pair of equilength pieces and a second pair of equilength pieces, each of said pieces having a first and second end zone and being of common cross section and adapted to be severed from an elongate length of rigid metal material for assembly into said mounting frame, said mounting frame including said pairs of pieces and four corner connector means of common size and shape connecting said pieces together in rectangular mounting frame defining relation, said mounting frame being adapted for use in mounting a sheet of deformable, stretchable, canvas material with completed art work in spanning relation of the mounting frame for subsequent mounting of the mounting frame and art work in a display frame, each of said pieces of said mounting frame including a first generally planar wall having an outer slide surface in a common plane, and a second outboard wall comprising the outer surface of said mounting frame and rigidifying wall means joining said slide surface and said outboard peripheral surface and defining a longitudinally extending connector means seat of common size within each piece extending between the respective first and second ends and said seat of each piece being sized to telescopingly receive a companionately sized corner connector means, each of said corner connector means connecting two adjacent pieces in frame defining relation, a stretch guide and keeper means comprising a plurality of spaced teeth extending outwardly away from each of said pieces and said mounting frame and the longitudinally extending connector means seat, and said slide surface not obstructing sliding outboard movement over said slide surface, said teeth having a pointed distal end and a pair of side edges converging outwardly away from the frame and the points of adjacent teeth being spaced from one another in a row and there being between two and eight teeth per linear inch along each piece, each of said connector means comprising an L-shaped member including a first leg and a second leg, and each of said legs being sized to be received in longitudinally extending relation within the seats on the end zone of adjacent pieces of the first and second pair to captivate a piece of each pair together in mounting frame defining relation.

2. The device as set forth in claim 1 wherein said slide surface and said outboard peripheral surface are at right angles to one another.

3. The device as set forth in claim 2 wherein said rigidifying wall means of each of said pieces comprises a first piece wall and a second piece wall joining said slide and peripheral surfaces.

4. The device as set forth in claim 1 wherein an exteriorly accessible longitudinally extending groove is provided said rigidifying wall means.

* * * * *